US007004731B2

(12) United States Patent
Kleibrink

(10) Patent No.: US 7,004,731 B2
(45) Date of Patent: Feb. 28, 2006

(54) DIAPHRAGM PUMP HAVING A GAS VENTING SURFACE

(76) Inventor: Horst Kleibrink, Heisenbergstr. 16, 45473 Muelheim-Rhur (DE)

( * ) Notice: Subject to any disclaimer, the term of this patent is extended or adjusted under 35 U.S.C. 154(b) by 241 days.

(21) Appl. No.: 10/379,059

(22) Filed: Mar. 4, 2003

(65) Prior Publication Data

US 2003/0170126 A1 Sep. 11, 2003

(30) Foreign Application Priority Data

Mar. 5, 2002 (DE) ..... 102 09 758

(51) Int. Cl.
*F04B 35/02* (2006.01)
*F04B 43/06* (2006.01)
*F04B 39/00* (2006.01)

(52) U.S. Cl. ..... 417/385; 417/383; 417/395; 417/572; 417/53

(58) Field of Classification Search ..... 417/383, 417/385, 395, 572; 92/98 R
See application file for complete search history.

(56) References Cited

U.S. PATENT DOCUMENTS

| | | | | | |
|---|---|---|---|---|---|
| 2,578,746 | A | * | 12/1951 | Scherger et al. | 417/388 |
| 4,109,535 | A | * | 8/1978 | Reed et al. | 73/706 |
| 4,136,603 | A | * | 1/1979 | Doyle, Jr. | 92/98 R |
| 4,430,048 | A | * | 2/1984 | Fritsch | 417/383 |
| 4,580,952 | A | * | 4/1986 | Eberle | 417/383 |
| 4,828,464 | A | * | 5/1989 | Maier et al. | 417/388 |
| 4,832,581 | A | * | 5/1989 | Muller et al. | 417/383 |
| 6,120,033 | A | * | 9/2000 | Filippi et al. | 277/315 |

FOREIGN PATENT DOCUMENTS

| | | | |
|---|---|---|---|
| DE | 31 46222 | * | 6/1983 |
| DE | 31 46222 A1 | * | 6/1983 |

* cited by examiner

*Primary Examiner*—Charles G. Freay
*Assistant Examiner*—Timothy P. Solak
(74) *Attorney, Agent, or Firm*—McCormick, Paulding & Huber LLP

(57) ABSTRACT

A scarred surface structure on the cover curvature of a diaphragm compressor is created by shot blasting. The scarred surface structure hinders the sealing effect between the cover curvature and the diaphragm and thereby counteracts the formation of gas cushions.

4 Claims, 2 Drawing Sheets

DIAPHRAGM PUMP HAVING A GAS VENTING SURFACE

CROSS REFERENCE TO RELATED APPLICATION

Applicant hereby claims foreign priority under 35 U.S.C. §119 from German Application No. 102 09 758.5 filed 5 Mar. 2002.

BACKGROUND OF THE INVENTION

The invention concerns a method for optimizing the gas flow within a diaphragm compressor and a compressor with optimized gas flow.

Diaphragm compressors work similarly to normal piston compressors, however, with a separating diaphragm between the gas side and the oil side. The oil side is formed by the usual piston-cylinder unit, whose working and dead volumes are entirely filled with oil. The gas suction and pressure valves are located on the gas side. The volume displaced by the oscillating movement of the piston is transmitted to the diaphragm, which in turn takes over the intake, the compression and the expulsion of the gases. Since the oil pressure during the entirety of the strokes of the intake and compression phases corresponds to that of the gas pressure, one can hear also reference to the method of operation of a piston compressor.

A minor difference from piston compressors however exists in that in a diaphragm compressor a secondary oil flow circuit must be installed in order to be able to compensate for the oil leakage of the piston. For this purpose a compensation pump driven by an eccentric on the crank shaft is used. This pump thus in synchronism with each piston stroke sprays a small amount of oil into the oil space of the compressor. This amount must theoretically be exactly as large as the leakage at the compressor piston. Since this technically is not realizable constantly an injected amount of oil is used which is larger than the leakage amount. This in turn has the result that with each stroke of the compressor piston somewhat too much oil is contained in the oil space, which then at the forward dead point of the diaphragm (that is, lying on the cover) would lead to an uncontrollable rise in the oil pressure. To prevent this from happening an oil overflow valve must also be added, which limits the oil pressure at the forward dead point of the piston to a value which lies slightly above the maximum pressure of the gas. The curved shape of the cover against which the diaphragm lies is determined according to purely mathematical requirements so that the diaphragm as deformed by the pressure can roll from the outer edge inwardly onto the cover surface. In the broadest sense, in comparison with a piston compressor the diaphragm works as the piston and the cover surface as the cylinder. A problem however exists in that the progressive sealing effect between the diaphragm and the cover does not correspond to that between a piston with its piston rings and a cylinder wall. Between the diaphragm and the cover surface localized gas cushions can be formed which both enlarge the wasted space and also shorten the life of the diaphragm. These localized gas cushions act as sealed off islands and do not disappear even at an overly high oil pressure.

The diaphragm compressors illustrated in publications DE-AS 1 132 285 and DE-AS 1 653 465 show no constructional features which permit a desired flow path for counteracting the localized formation of cushions between the diaphragm and the cover surface.

Along with a constructional optimization for the flow in the oil side (DE 10056708) there also exist measures for improving the gas flow out of gas cushions formed between the cover surface and the diaphragm. These consist of radially arranged small grooves which come star-shaped from the outer curved area and in which sieve holes lead to the pressure valve inlet in the center of the cover. This star shaped groove pattern however does not guarantee a definite intake area from which the gas cushions can with certainty be withdrawn. There always remains further gas nests which become hermetically sealed by the smooth surface of the cover curvature and the diaphragm from the neighboring areas. Indeed, if the described grooves are located in the neighboring areas. The addition of a larger number of radially arranged grooves poses however an enlargement of the wasted space and a high increase in manufacturing expense.

SUMMARY OF THE INVENTION

The object of the invention is to provide a method through which the internal formation of cushions is strongly reduced or eliminated by the elimination of the sealing effect between the smooth cover curvature and the diaphragm.

This object is solved by a scarred surface for the cover curvature produced by shot blasting.

BRIEF DESCRIPTION OF DRAWINGS

An exemplary embodiment of the invention is illustrated in the drawings and is described in more detail in the following.

DESCRIPTION OF THE PREFERRED EMBODIMENTS

Figure 1:
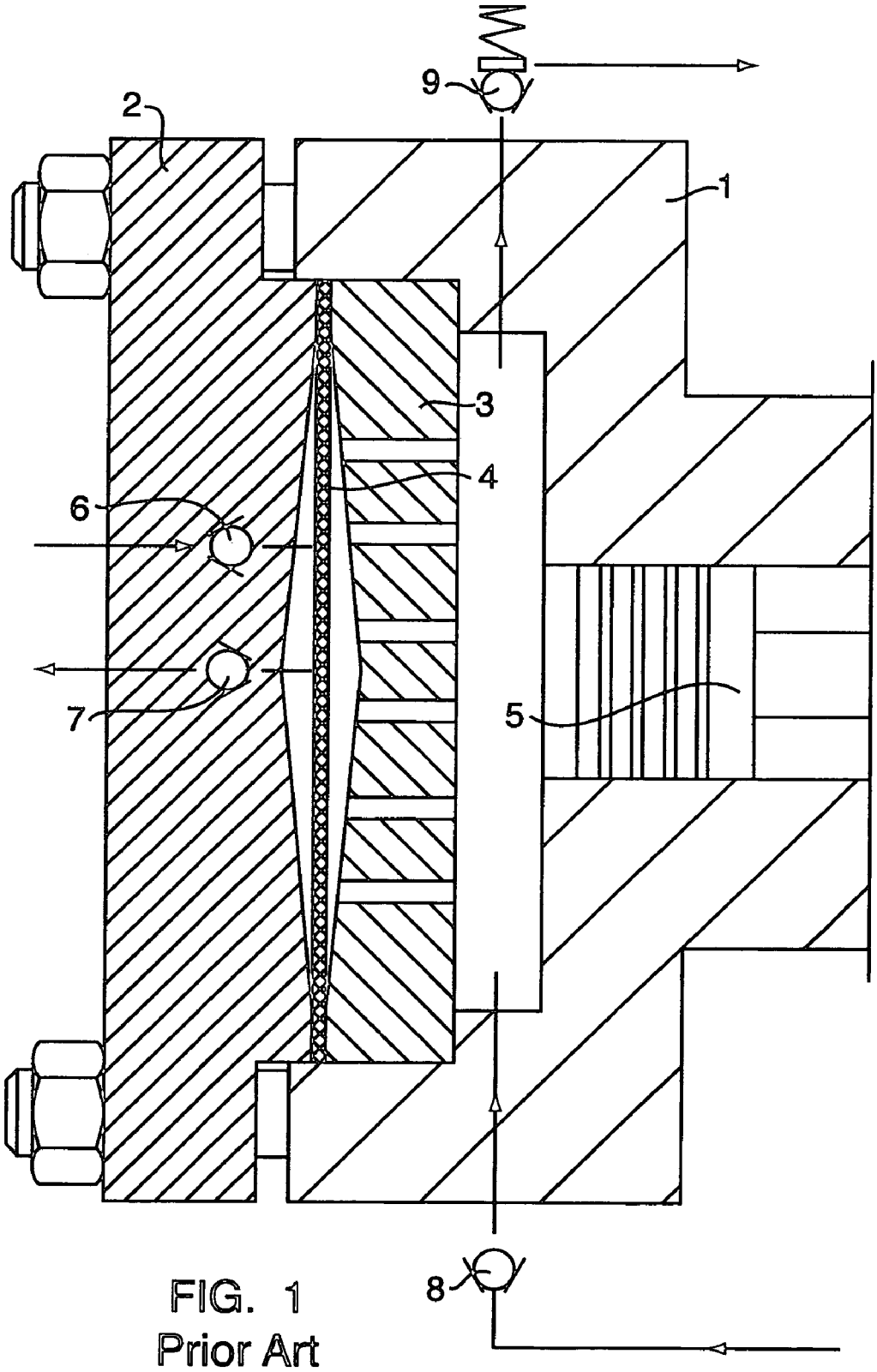
FIG. 1 Prior Art
FIG. 1 shows a complete diaphragm head in an embodiment according to the state of the technology.

The main components of a diaphragm compressor exists according to FIG. 1 of the flange (1) with a cylinder, the cover (2), the aperture plate (3), the diaphragm (4), the piston (5), the suction valve (6), the pressure valve (7), the check valve (8) and the oil overflow valve (9). The volume designated as oil space extends between the piston (5) and the diaphragm (4). The volume designated as gas space extends from the diaphragm (4) to the cover (2). The diaphragm stroke volume is determined by the piston stroke volume (surface x stroke) so that essentially the functioning of a piston compressor exists. The diaphragm runs in volume synchronization with the piston, sucks in the gas through the intake valve (6) compresses it and pushes it out through the pressure valve (7).

The oil leakage at the piston (5) must be compensated by an external pump. For this a small piston pump driven by a eccentric is used which each stroke injects a small amount of oil through the check valve (8) into the oil space. Thereby, since the eccentric sits directly onto the crankshaft, in synchronism with each stroke of the main piston (5) exactly dosed injection by the compensation pump takes place. Since this injected amount of oil for operational security must always be greater than the leakage at the piston (5) an oil overflow valve (9) is required which allows the excessive amount of sprayed in oil to flow off at the forward dead point of the piston (5) and diaphragm (4).

The inwardly going forward movement of the piston (5) with each pressure stroke pushes the oil through the apertures of the aperture plate (3) in front of the diaphragm, which diaphragm then on its side lies entirely on the cover surface at the forward dead point of the piston. Despite the mathematical determination of the cover curvature which should favor a rolling on process of the diaphragm from the outward edge region toward the inward center, it always occurs that between the diaphragm and the cover surface localized gas cushions are formed. The oil flowing through the aperture plate at the same time works on the entire surface of the diaphragm.

Figure 2:
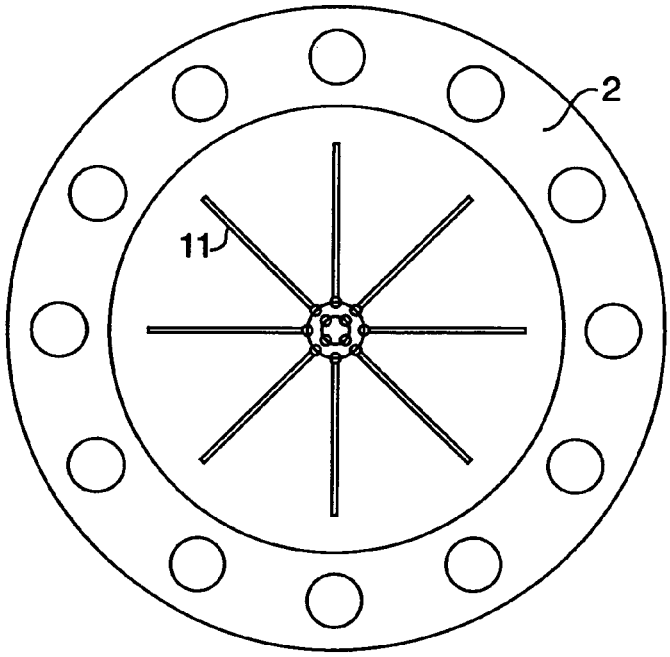
FIG. 2 Prior Art
FIG. 2 shows the arrangement of the grooves in a cover according to the state of the technology.

The system illustrated in FIG. 2 with radially arranged grooves (11) makes possible only a limited outflow of the gas cushions formed between the cover curvature and the diaphragm. The main reasons for this cushion formation are the use of not entirely planar diaphragms, as well as the use of smooth surfaces to improve diaphragm service life. These smooth surfaces precisely exercise the principle of a metallic seal whereby once enclosed gas, nests can hardly be removed.

The radially arranged grooves (11) also can be effective only for definite areas in their immediate vicinity. Clearly in the outer diametric regions the spaces between the grooves are large and in these spaces isolated sealed gas cushions can be formed which can establish no connection with the grooves. A larger number of grooves is prohibited because of the waste space becoming larger; and also because the diaphragm compressor would be driven at a higher compression ratio than that which would be the case for the piston compressor. Moreover this measure would drive the finishing costs up.

Figure 3:
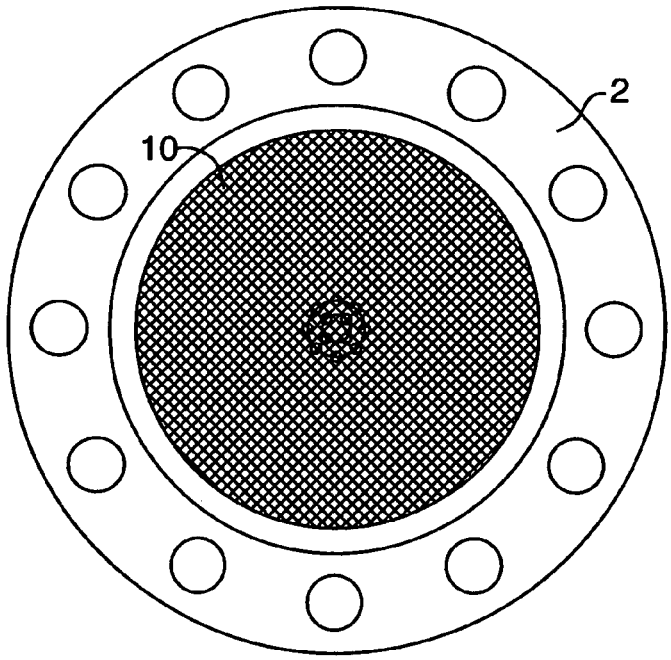
FIG. 3 shows the surface structure of the cover curvature as it appears after the shot blasting procedure.

FIG. 3 shows the scarred or stipple-like surface structure (10) of the cover curvature according to the invention. This structure, created by shot blasting, removes the sealing effect between the cover curvature and the diaphragm over their entire engagement surfaces. With the removal of the sealing effect between the cover curvature and the diaphragm, one of the prerequisites for the formation of cushions no longer exists, since the principle of partial sealing off can no longer take hold. With the removal of the grooves there exists also a cost advantage, since with the new method of shot blasting a cost effective mass production method is provided.

In the preferred procedure glass balls are used and are so adjusted as to their impact speed that a scarred surface structure (10) similar to that of an orange peel is formed which does not allow the localized tension peaks inside of the diaphragm sheet to rise essentially any higher and at the same time also allows no compression of the diaphragm to occur.

I claim:

1. A diaphragm compressor with a diaphragm hydraulically driven by a piston against a cover curvature progressively from the outward edge region toward the inward center, characterized by the cover curvature having a scarred or stippled surface structure (10).

2. A diaphragm compressor as defined in claim 1 wherein the scarred or stippled surface structure (10) is formed by shot blasting.

3. A method for optimizing the gas flow within a diaphragm compressor with a diaphragm hydraulically driven by a piston against a cover curvature from the outward edge region toward the inward center, characterized by creating the cover curvature with a scarred surface structure (10) by means of shot blasting.

4. A diaphragm compressor comprising:

a cover having a cover curvature with a scarred or stippled surface structure; and a generally planar diaphragm hydraulically driven against the cover curvature progressively from an outward edge region toward an inward center of the cover curvature;

wherein the scarred or stippled surface structure of the cover curvature is configured for preventing a sealing effect between the diaphragm and cover curvature, over their entire engagement surfaces, when the diaphragm is driven against the cover curvature.

* * * * *